US010731843B2

(12) United States Patent
Guillet et al.

(10) Patent No.: US 10,731,843 B2
(45) Date of Patent: Aug. 4, 2020

(54) UNDERWATER LIGHTING DEVICE

(71) Applicant: SIELED, Saint Paul de Varces (FR)

(72) Inventors: Christian Guillet, Saint Paul de Varces (FR); Patrick Pellaton, Voreppe (FR)

(73) Assignee: SIELED, Saint Paul de Varces (FR)

( * ) Notice: Subject to any disclaimer, the term of this patent is extended or adjusted under 35 U.S.C. 154(b) by 0 days.

(21) Appl. No.: 15/900,277

(22) Filed: Feb. 20, 2018

(65) Prior Publication Data

US 2018/0172261 A1 Jun. 21, 2018

Related U.S. Application Data

(63) Continuation of application No. 14/971,570, filed on Dec. 16, 2015, now abandoned.

(51) Int. Cl.

| | |
|---|---|
| ***F21V 1/00*** | (2006.01) |
| ***F21V 31/00*** | (2006.01) |
| ***F21V 11/00*** | (2015.01) |
| ***F21V 29/70*** | (2015.01) |
| ***F21V 15/00*** | (2015.01) |
| ***F21V 3/06*** | (2018.01) |
| ***F21V 5/00*** | (2018.01) |
| *F21V 29/506* | (2015.01) |

(Continued)

(52) U.S. Cl.

CPC ..... *F21V 31/00* (2013.01); *F21V 3/061* (2018.02); *F21V 3/062* (2018.02); *F21V 5/007* (2013.01); *F21V 11/00* (2013.01); *F21V 15/00* (2013.01); *F21V 29/70* (2015.01); *F21V 5/04* (2013.01); *F21V 23/005* (2013.01); *F21V 29/506* (2015.01); *F21V 29/507* (2015.01); *F21V 29/56* (2015.01); *F21V 29/83* (2015.01)

(58) Field of Classification Search

CPC ..... F21W 2101/04; F21W 2131/401; F21W 2107/20; F21V 31/04; F21V 31/06; F21V 15/01; F21V 23/004; F21V 23/005; H01L 33/64

See application file for complete search history.

(56) References Cited

U.S. PATENT DOCUMENTS

| | | | | |
|---|---|---|---|---|
| 9,057,811 | B2 * | 6/2015 | Kasuga | G02B 6/0085 |
| 2005/0036305 | A1 | 2/2005 | Kersey | |

(Continued)

FOREIGN PATENT DOCUMENTS

| | | |
|---|---|---|
| CN | 202521428 U | 11/2012 |
| DE | 10 2012 101 411 A1 | 8/2013 |

(Continued)

OTHER PUBLICATIONS

Aug. 18, 2017 Office Action Issued in U.S. Appl. No. 14/971,570.

*Primary Examiner* — Matthew J. Peerce
(74) *Attorney, Agent, or Firm* — Oliff PLC

(57) ABSTRACT

This device includes an electronic board including a front surface; at least one light emitter assembled on the front surface; a protective cover configured to protect the electronic board and the at least one light emitter; a thermally-conductive resin layer having a heat exchange surface meant to be in direct contact with the aquatic environment, the thermally-conductive resin layer being configured to transfer the heat generated by the at least one light emitter to the heat exchange surface, and configured to ensure the sealing of the protective cover with the heat exchange surface.

5 Claims, 8 Drawing Sheets

(51) Int. Cl.

| | |
|---|---|
| *F21V 5/04* | (2006.01) |
| *F21V 23/00* | (2015.01) |
| *F21V 29/56* | (2015.01) |
| *F21V 29/83* | (2015.01) |
| *F21V 29/507* | (2015.01) |

(56) References Cited

U.S. PATENT DOCUMENTS

| | | | | |
|---|---|---|---|---|
| 2006/0187652 | A1 | 8/2006 | Doyle | |
| 2007/0121326 | A1* | 5/2007 | Nall | F21V 29/004 362/294 |
| 2007/0139913 | A1* | 6/2007 | Savage | B63B 45/02 362/101 |
| 2010/0302789 | A1* | 12/2010 | Li | F21K 9/00 362/373 |
| 2011/0063831 | A1* | 3/2011 | Cook | F21S 8/02 362/235 |
| 2011/0267834 | A1* | 11/2011 | Potucek | F21S 8/00 362/551 |
| 2011/0309403 | A1 | 12/2011 | Kawashima | |
| 2017/0365754 | A1* | 12/2017 | Fukasawa | F21V 31/00 |

FOREIGN PATENT DOCUMENTS

| | | | | |
|---|---|---|---|---|
| DE | 102012101411 | A1 * | 8/2013 | F21V 25/12 |
| EP | 2 383 508 | A1 | 11/2011 | |
| EP | 2 594 245 | A1 | 5/2013 | |
| FR | 2 935 459 | A1 | 3/2010 | |
| FR | 2 968 333 | A1 | 6/2012 | |
| WO | 2012/041638 | A1 | 4/2012 | |
| WO | 2013/062492 | A1 | 5/2013 | |

* cited by examiner

UNDERWATER LIGHTING DEVICE

This is a continuation of application Ser. No. 14/971,570 filed Dec. 16, 2015. The entire disclosure of the prior application is hereby incorporated by reference in its entirety.

TECHNICAL FIELD

The present invention relates to an underwater lighting device.

BACKGROUND ART

An underwater lighting device known in the state of the art, particularly from document EP 2 594 245, comprises:

an electronic board comprising a surface, called front surface, light-emitting means assembled on the front surface of the electronic board, a protective cover arranged to protect the electronic board and the light-emitting means, heat transfer means arranged to transfer the heat generated by the light-emitting means to the aquatic environment.

The heat transfer means comprise a metal plate assembled on the surface, called rear surface, opposite to the front surface of the electronic board. The metal plate is intended to be submerged in the aquatic environment to benefit from a heat exchange with the aquatic environment in order to be cooled. The metal plate thus enables to dissipate the heat essentially generated by the light-emitting means, such as light-emitting diodes, particularly power diodes. Indeed, in the absence of heat transfer means, it can be observed that the temperature of the electronic board strongly increases, which may deteriorate the electronic board and the light-emitting means in case of an extended operation of the device.

However, such a device of the state of the art is not fully satisfactory since it requires a conical seal, typically made of rubber, arranged between the metal plate and the protective cover, to prevent the coming into contact of the electronic board and of the light-emitting means with the aquatic environment.

Now, such a conical seal requires the forming of shoulders in the protective cover to create support surfaces for the seal. The forming of shoulders in the protective cover also results in the forming of shoulders in the metal plate. Indeed, the metal plate partly rests on the rear surface of the electronic board, and partly on the shoulders of the protective cover. Accordingly, such a device of the state of the art introduces a complexity in the manufacturing thereof by specific machinings of the protective cover and of the metal plate.

Further, the metal plate is submitted to the external pressure of the aquatic environment. Now, the metal plate, which is rigid, transmits high stress to the seal. The seal undergoes compressive losses due to differential expansions with respect to the metal plate, which adversely affects the lifetime of the seal, and thereby of the device.

SUMMARY OF THE INVENTION

The present disclosure aims at overcoming all or part of the above-mentioned disadvantages and relates, for this purpose, to an underwater lighting device, comprising:

an electronic board comprising a surface, called front surface, light-emitting means assembled on the front surface of the electronic board, a protective cover arranged to protect the electronic board and the light-emitting means, heat transfer means arranged to transfer the heat generated by the light-emitting means to the aquatic environment, the device being remarkable in that the heat transfer means comprise at least one thermally-conductive resin layer having a heat exchange surface meant to be in direct contact with the aquatic environment, the resin layer being arranged with respect to the electronic board so as to transfer the heat generated by the light-emitting means to the heat exchange surface, and in that the resin layer is shaped relatively to the protective cover so as to ensure the sealing of the protective cover with the heat exchange surface.

"Resin layer" means a layer made of a resin-based material. Said material may be a one-component or multicomponent material. Said material may be used for coating or potting operations. Said material may be glue.

"Thermally conductive" means a resin layer which has a heat conductivity adapted to dissipate the heat generated by the light-emitting means, the resin layer being likely to have a ratio to the conductivity of air greater than or equal to 5.

It should be noted that a resin layer should not be confused with a foam.

Thus, such a resin layer enables to provide both:

the transfer of the heat generated by the light-emitting means to the heat exchange surface, and the sealing of the protective cover with the heat exchange surface to prevent the coming into contact of the electronic board and of the light-emitting means with the aquatic environment.

Such a device according to the invention can thus be easily manufactured in the absence of a dedicated seal and of specific machinings, particularly of the protective cover.

Further, such a resin layer enables to better absorb the outer pressure of the aquatic environment than a metal plate, which enables to improve the lifetime of the device.

Advantageously, the device comprises collimators arranged on the front surface of the electronic board to collimate the light emitted by the light-emitting means, and the resin layer has a thickness smaller than the height of the collimators.

It is thus possible to obtain a long distance underwater lighting device, which is compact and simple to manufacture. Such a resin thickness enables to do away with the presence of translation locking means on the collimators to prevent a translation of the resin along the direction perpendicular to the front surface in the case of an overmolding above the collimators.

Advantageously, the collimators comprise a shoulder extending on the front surface of the electronic board, and the resin layer extends on the shoulder.

Thus, such a shoulder enables to significantly improve the adherence and the sealing of the resin layer with the collimators.

Advantageously, the thickness of the resin layer and the height of the collimators have a ratio greater than 0.7, preferably in the range from 0.85 to 0.95.

Thus, such a ratio enables to combine a good heat conductivity of the resin layer and a good sealing between the resin layer and the collimators.

Advantageously, there is an interface between the resin layer and the collimators, and the collimators are adapted so that the interface has a surface tension in the range from 65 dyn to 80 dyn.

Thus, such a surface tension enables to obtain an interface with an excellent tightness. The collimators are preferably adapted by means of a surface treatment such as flame treatment.

In an embodiment, the resin layer has a surface of direct contact with the front surface of the electronic board, and the ratio of the area of said direct contact surface to the front surface area is greater than or equal to 5%, preferably greater than or equal to 10%, preferably still greater than or equal to 20%.

Thus, the fact for the resin layer to be in direct contact with the front surface of the electronic board enables to suppress air between the electronic board and the protective cover and, thereby, to improve the heat dissipation since air is a poor heat conductor. The area of the direct contact surface is adapted to the power of the light-emitting means.

In an embodiment, the resin layer extends all over the front surface of the electronic board in direct contact.

Thus, the heat dissipation generated by the light-emitting means is facilitated by increasing the heat exchange surface area.

In an embodiment, the electronic board comprises a surface, called rear surface, opposite to the front surface, the resin layer has a surface of direct contact with the rear surface of the electronic board, and the ratio of the area of said direct contact surface to the rear surface area is greater than or equal to 5%, preferably greater than or equal to 10%, preferably still greater than or equal to 20%.

Thus, for certain electronic boards, for example, of IMS (Insulated Metal Substrate) type, the heat generated by the light-emitting means mainly accumulates at the rear surface of the electronic board. The fact for the resin layer to be in direct contact with the rear surface of the electronic board allows the transfer of said heat to the heat exchange surface.

In an embodiment, the electronic board comprises a surface, called rear surface, opposite to the front surface, and the resin layer extends all over the rear surface of the electronic board in direct contact.

Thus, the heat dissipation generated by the light-emitting means is facilitated by increasing the heat exchange surface area.

In an embodiment, the heat transfer means comprise a heat exchanger interposed between the electronic board and the resin layer, the heat exchanger being preferably selected from the group comprising a metal plate or a U-tube exchanger.

Thus, interposing a heat exchanger between the electronic board and the resin layer enables to decrease the resin layer thickness necessary to obtain a heat exchange surface meant to be in direct contact with the aquatic environment.

Advantageously, the resin layer is arranged to cover the heat exchanger.

Thus, such a resin layer ensures the additional function of protecting the heat exchanger, particularly against corrosion.

In an embodiment, the device comprises collimators arranged to collimate the light emitted by the light-emitting means.

It is thus possible to obtain a long-distance underwater lighting.

Advantageously, the device comprises through openings made in the electronic board opposite the collimators.

Thus, such through openings enable to avoid the forming of air bubbles in the resin layer originating from the air trapped between the collimators and the electronic board. Such through openings enable to exhaust the air.

Advantageously, the resin layer comprises a metal filler.

Thus, the presence of a metal filler enables to increase the heat conductivity of the resin layer, and thereby to improve the transfer of the heat generated by the light-emitting means to the heat exchange surface.

In an embodiment, the resin layer has an expansion coefficient adapted with respect to the expansion coefficient of the electronic board and to the temperature of the aquatic environment, particularly to avoid the tearing of the light-emitting means when the device is submerged in the aquatic environment.

Thus, such a resin layer enables to protect the electronic board from deformations linked to the outer pressure of the aquatic environment.

According to an embodiment, the resin layer is formed from a cast resin selected from the group comprising polyepoxides, polyurethanes, polyesters, and polysiloxanes, acrylics, and methyl methacrylates.

Thus, such resins are selected, in particular, for their flexibility and their heat conductivity, which is much greater than that of air.

BRIEF DESCRIPTION OF THE DRAWINGS

The foregoing and other features and advantages will be discussed in detail in the following non-limiting description of different embodiments of a device according to the invention, in connection with the accompanying drawings, among which.

DETAILED DESCRIPTION OF THE EMBODIMENTS

Figure 1:
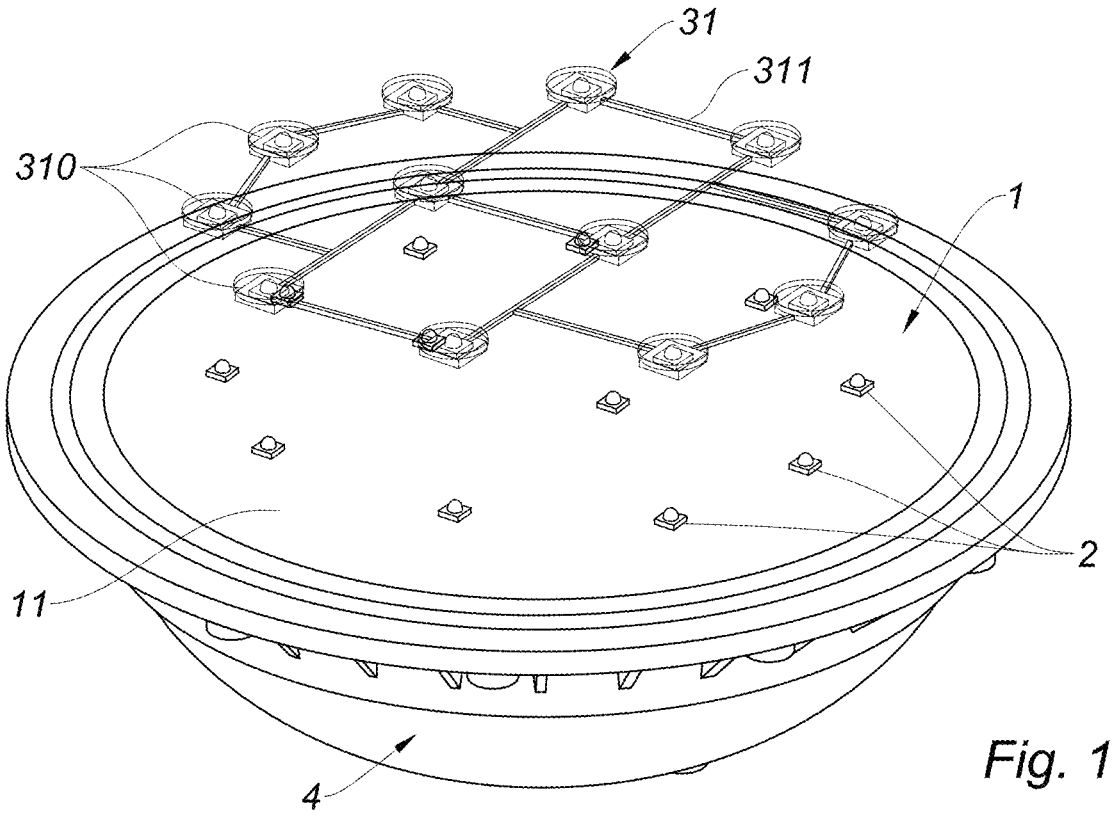
FIG. 1 is an exploded perspective view of a first device according to the invention before the forming of the resin layer.
Figure 2:
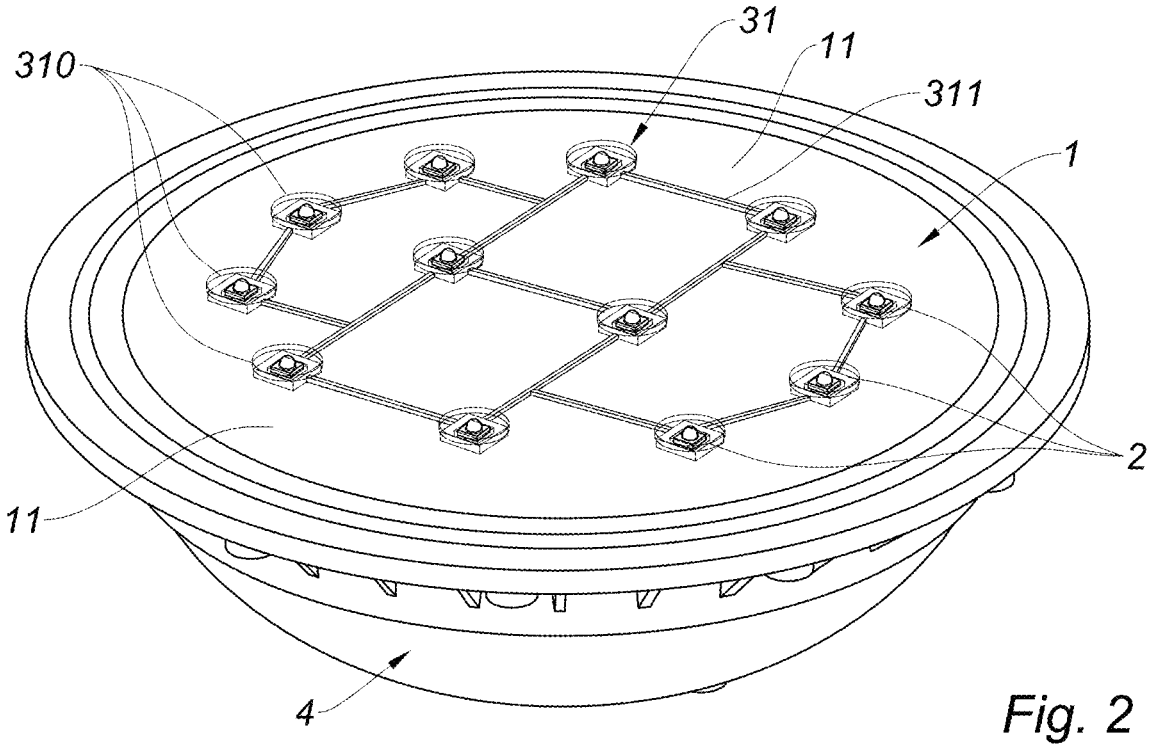
FIG. 2 is a perspective view of the device illustrated in FIG. 1.
Figure 3:
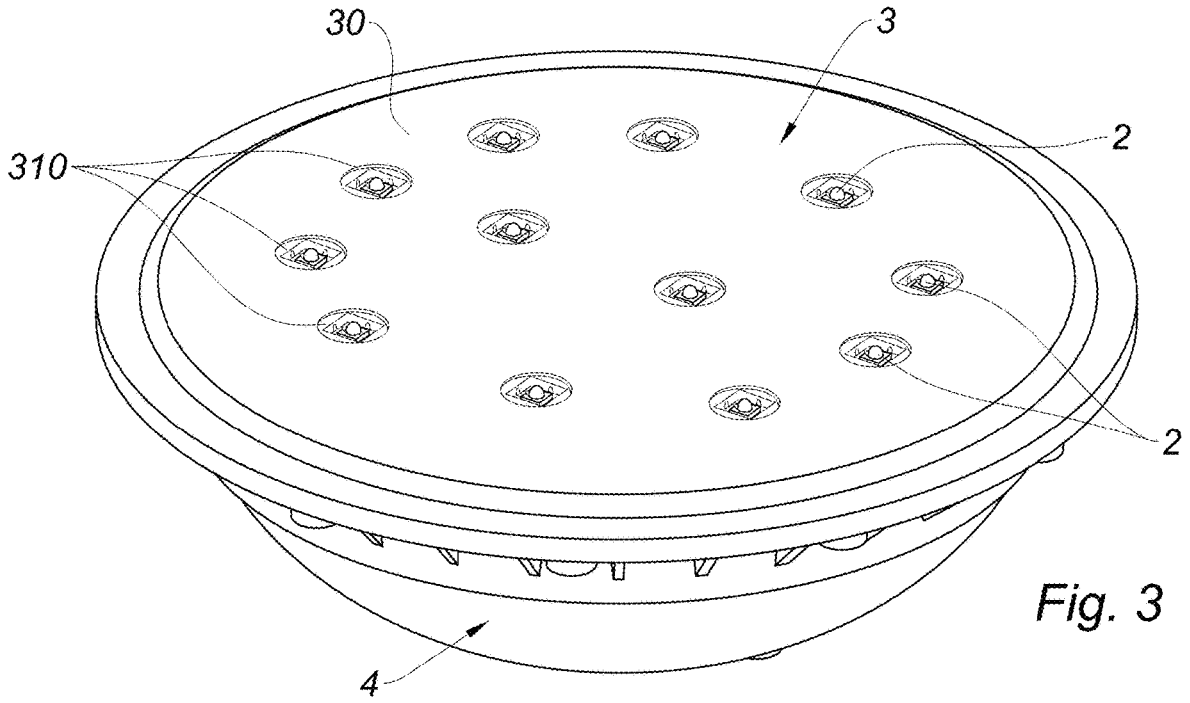
FIG. 3 is a perspective view of the device illustrated in FIG. 1 after the forming of the resin layer.
Figure 4:
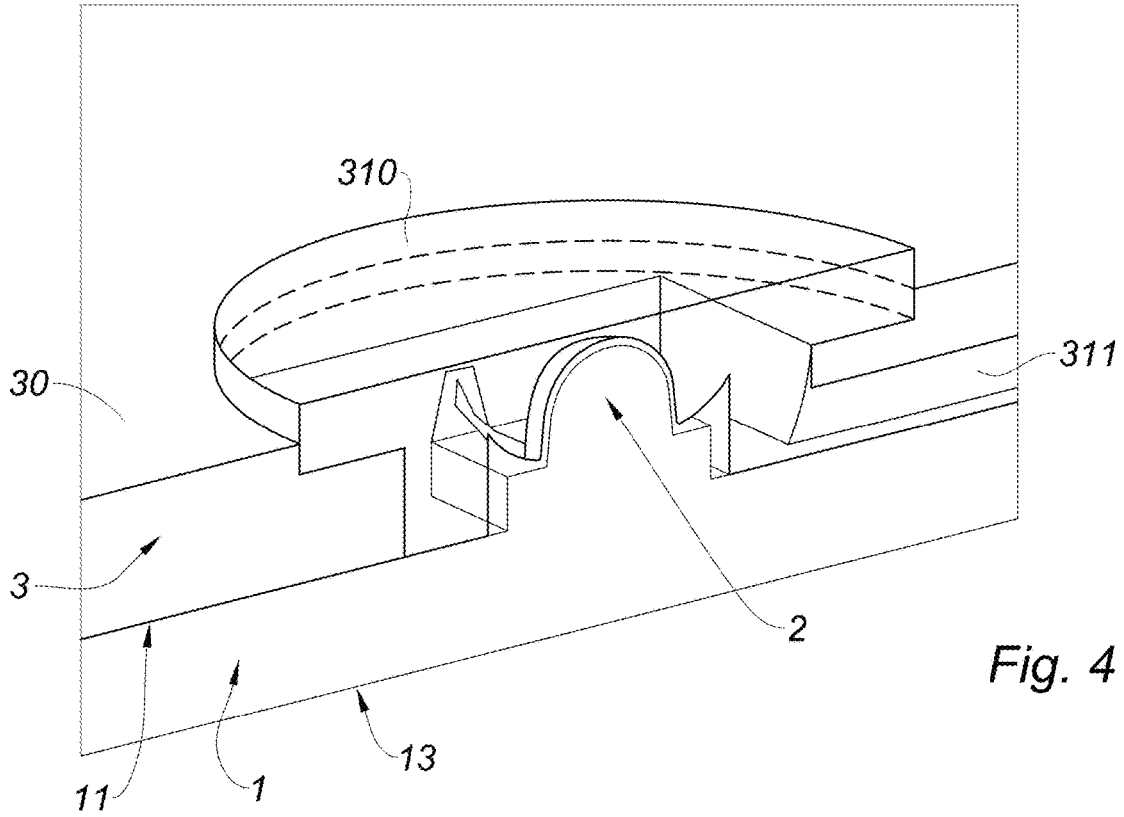
FIG. 4 is a perspective detail view of the device illustrated in FIG. 3.

For the different embodiments, the same references will be used for identical elements or elements performing the same function, to simplify the description. The technical characteristics described hereafter for different embodiments are to be considered separately or according to any technically possible combination.

The first device illustrated in FIGS. 1 to 4 is an underwater lighting device, comprising:

- an electronic board 1 comprising a surface, called front surface 11,
- light-emitting means 2, preferably of light-emitting diode type, assembled on front surface 11 of electronic board 1,
- a protective cover 4 arranged to protect electronic board 1 and light-emitting means 2,
- heat transfer means for transferring the heat generated by light-emitting means 2 to the aquatic environment.

Electronic board 1 comprises a circuit for controlling light-emitting means 2. Electronic board 1 preferably is in the shape of a disk. As a non-limiting example, electronic board 1 may also be parallelepiped-shaped. Front surface 11 of electronic board 1 is advantageously planar. Front surface 11 of electronic board 1 is preferably circular. Electronic board 1 may be made of a material which is a good heat conductor to uniformly distribute the heat generated by light-emitting means 2 at front surface 11 of electronic board 1. Front surface 11 of electronic board 1 may comprise a coating adapted to reflect light and/or heat so as to increase the heat transfer to heat exchange surface 30.

Light-emitting means 2 may be distributed at front surface 11 of electronic board 1 to avoid a local heat concentration. Thus, the distances between two neighboring areas of front surface 11 occupied by light-emitting means 2 may be substantially identical.

The device comprises collimators 310 arranged on front surface 11 of electronic board 1 to collimate the light emitted by light-emitting means 2. Collimators 310 may be interconnected by branches 311 to form a network 31 of collimators 310. Such collimators 310 in a network are simple to install. Network 31 of collimators 310 is preferably made of a plastic material. Network 31 of collimators 310 may be equipped with an adapted lens to allow interplays of light such as color mixing. Network 31 of collimators 310 occupies an area of front surface 11 of electronic board 1.

Protective cover 4 is a half-shell in the shape of a half-sphere which may be made of a plastic material. Other shapes are of course possible for protective cover 4. Protective cover 4 delimits an enclosure within which electronic board 1 is arranged.

The heat transfer means comprise a thermally-conductive resin layer 3 having a heat exchange surface 30 meant to be in direct contact with the aquatic environment. Resin layer 3 is arranged relatively to electronic board 1 to transfer the heat generated by light-emitting means 2 to heat exchange surface 30. More specifically, resin layer 3 extends on the area complementary to front surface 11 of electronic board 1 in direct contact. "Complementary" is used in the mathematical meaning of the term; front surface 11 of the electronic board is a set, the area occupied by network 31 of collimators 310 is a subset and the complementary of said occupied area (called complementary area) is the assembly of the elements of front surface 11 of electronic board 1 which do not belong to said occupied area. Resin layer 3 is shaped relatively to protective cover 4 to ensure the sealing of protective cover 4 with heat exchange surface 30. Resin layer 3 may comprise a metal filler. Resin layer 3 advantageously has an expansion coefficient adapted with respect to the expansion coefficient of electronic board 1 and to the temperature of the aquatic environment, particularly to avoid the tearing of light-emitting means 2 when the device is submerged in the aquatic environment. Resin layer 3 may be transparent, translucent, or opaque in the visible range. Resin layer 3 is preferably formed from a cast resin selected from the group comprising polyepoxides, polyurethanes, polyesters, polysiloxanes, acrylics, and methyl methacrylates. Resin layer 3 advantageously has a thickness smaller than the height of collimators 310.

An experiment has been conducted when resin layer 3 is based on polyurethane, the results thereof being gathered in the following table. The table shows the intensity (a.u.) consumed by light-emitting means 2 according to the temperature of the aquatic environment and to the thickness of the resin layer.

Light-emitting means 2 are equipped with a temperature probe which enables to inform a control unit to decrease the consumed intensity as soon as there is a significant heating of electronic board 1.

Light-emitting means 2 should conventionally operate up to a 40° C. temperature.

| | Thickness of resin layer 3 (mm) | | | |
|---|---|---|---|---|
| Temperature (° C.) | 3.5 mm | 4 mm | 5 mm | 6 mm |
| 28° C. | | | 3.55 | 3.4 |
| 32° C. | 3.5 | 3.5 | 3.55 | 3.25 |
| 36° C. | 3.5 | 3.5 | 3.4 | 2.95 |
| 40° C. | 3.3 | 3.4 | 3.15-3.3 | 2.75 |

The table shows that the thickness of polyurethane resin layer 3 should be smaller than 5 mm. Above this value, the heat conduction of resin layer 3 is not sufficient to provide an efficient heat transfer to the aquatic environment. As an example, the thickness of resin layer 3 may be in the order of 4.5 mm and the height of collimators 310 may be in the order of 5 mm with a ratio in the order of 0.9.

Figure 5:
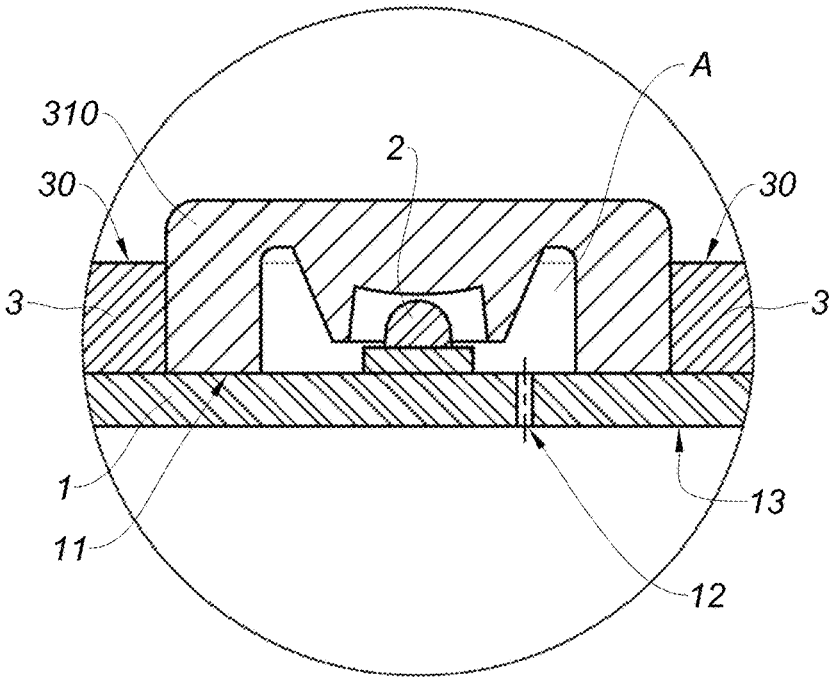
FIG. 5 is a partial cross-section view at an enlarged scale of a second device according to the invention.

In the embodiment illustrated in FIG. 5, the second device differs from the first device in that it comprises through openings 12 formed in electronic board 1 opposite collimators 310 to exhaust air A trapped between collimators 310 and electronic board 1. Through openings 12 advantageously have a sufficiently large size to avoid creating a pressure drop for air A, which should easily flow therethrough. A plurality of through openings 12 are advantageously formed in electronic board 1 opposite each collimator 310. As a non-limiting example, four circular through openings 12, having a 2.5-mm diameter, may be distributed around light-emitting means 2, opposite each collimator 310.

Figure 6:
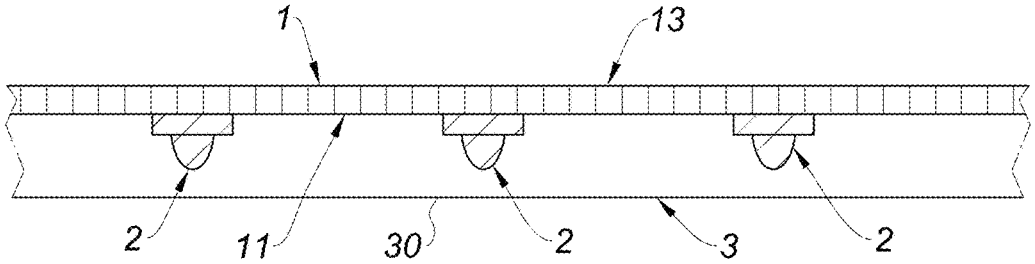
FIG. 6 is a partial cross-section view of a third device according to the invention.

In the embodiment illustrated in FIG. 6, the third device differs from the first device in that it comprises no collimators, and in that resin layer 3 extends all over front surface 11 of electronic board 1 in direct contact. Resin layer 3 may be transparent or translucent in the visible range. Resin layer 3 is preferably formed from a cast resin selected from the group comprising polyurethanes and polysiloxanes. Thus, such resins enable to combine an excellent light transmission and a heat conductivity much greater than that of air, the ratio being greater than 7.

Figure 7:
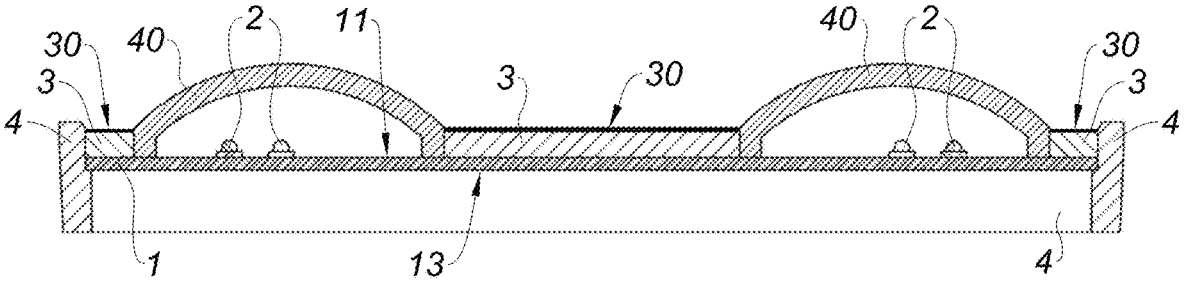
FIG. 7 is a partial cross-section view of a fourth device according to the invention.

In the embodiment illustrated in FIG. 7, the fourth device differs from the first device in that it comprises no collimators. Protective cover 4 comprises lenses 40 which may be made of glass or of a plastic material transparent or translucent in the visible range. Lenses 40 are arranged opposite light-emitting means 2. Lenses 40 of protective cover 4 occupy an area of front surface 11 of electronic board 1.

Resin layer 3 extends on the area complementary to front surface 11 of electronic board 1 in direct contact. "Complementary" is used in the mathematical meaning of the term; front surface 11 of the electronic board is a set, the area occupied by lenses 40 of protective cover 4 is a subset, and the complementary of said occupied area (called complementary area) is the assembly of the elements of front surface 11 of electronic board 1 which do not belong to said occupied area. The complementary area forms a central area between lenses 40 and a peripheral area between protective cover 4 and lenses 40.

Figure 8:
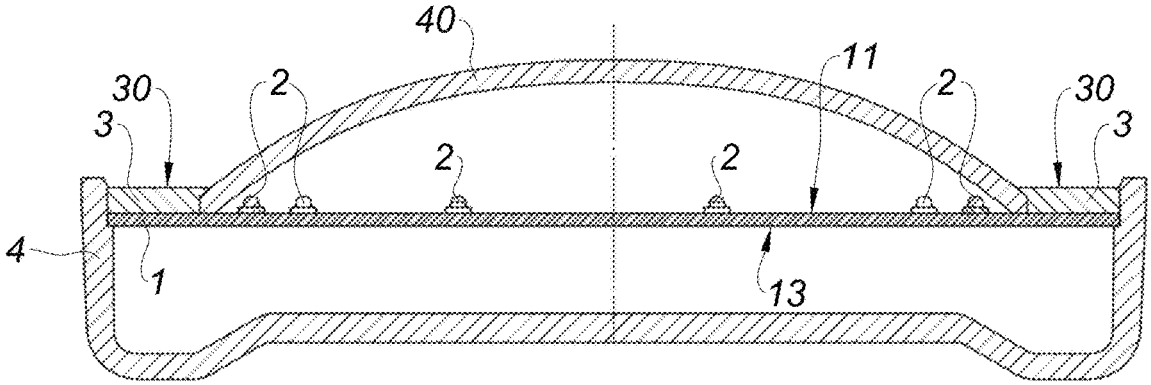
FIG. 8 is a cross-section view of a fifth device according to the invention.

In the embodiment illustrated in FIG. 8, the fifth device differs from the fourth device in that protective cover 4 comprises a lens 40 arranged opposite light-emitting means 2. Lens 40 occupies a central area of front surface 11 of electronic board 1. Resin layer 3 extends on the peripheral area complementary to front surface 11 of electronic board 1 in direct contact.

Figure 9:
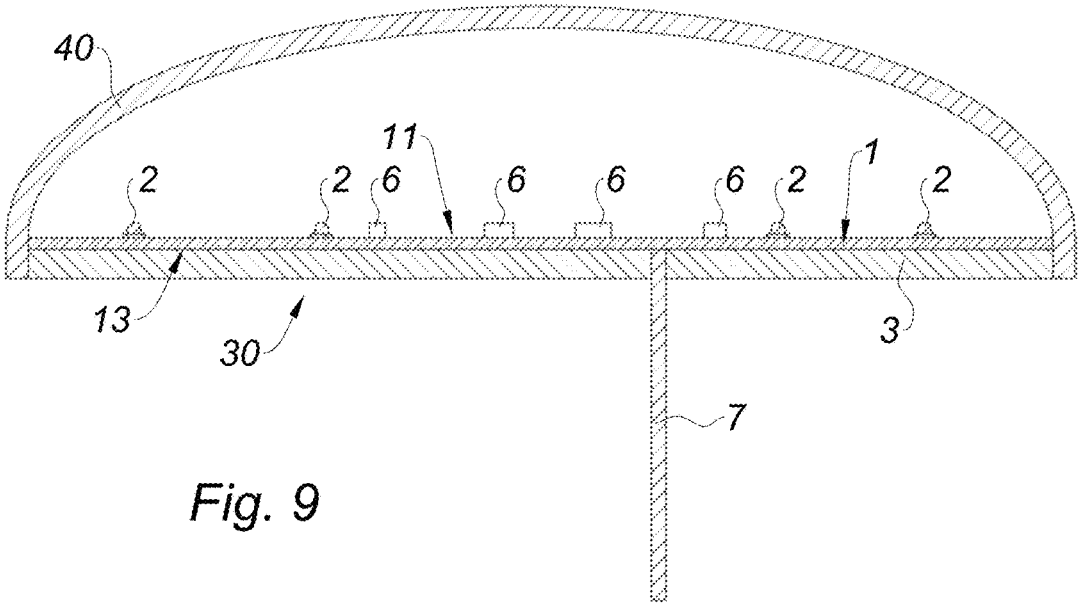
FIG. 9 is a cross-section view of a sixth device according to the invention.

In the embodiment illustrated in FIG. 9, the sixth device differs from the first device in that protective cover 4 comprises a lens 40 which may be made of glass or of a plastic material transparent or translucent in the visible range. Lens 40 is arranged opposite light-emitting means 2. Electronic board 1 comprises a surface, called rear surface 13, opposite to front surface 11, and resin layer 3 extends all over rear surface 13 of electronic board 1 in direct contact. Electronic board 1 comprises circuits 6 for controlling light-emitting means 2. Control circuits 6 are arranged on front surface 11 of electronic board 1. FIG. 9 also shows a wire 7 of connection to electronic board 1. This embodiment is particularly adapted to an electronic board 1 of IMS (Insulated Metal Substrate) type, the heat generated by light-emitting means 2 mainly accumulating at rear surface 13 of electronic board 1.

Figure 10:
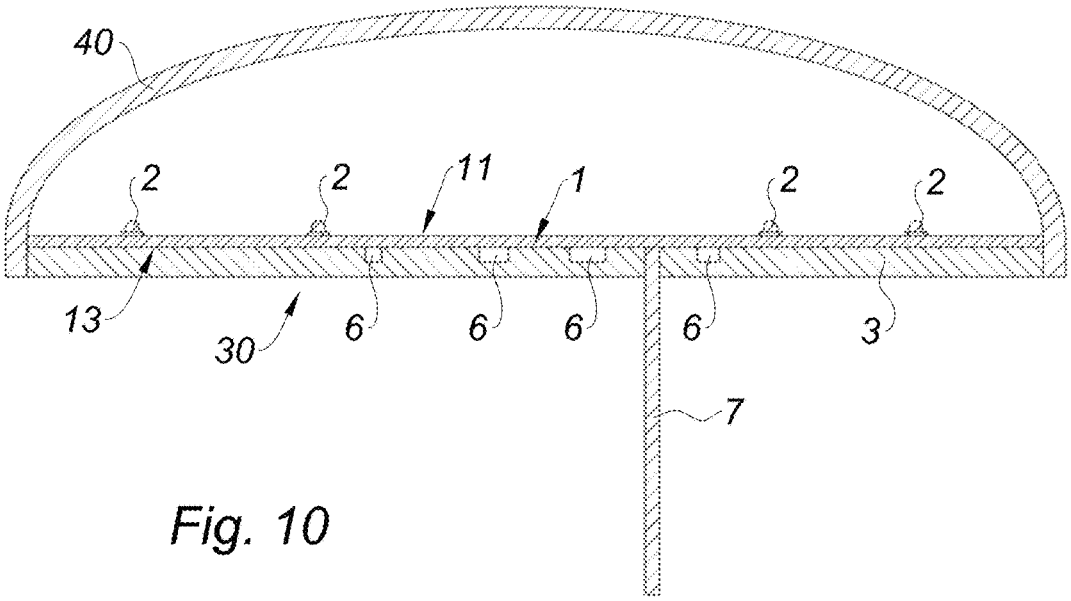
FIG. 10 is a cross-section view of a variation of the sixth device according to the invention.

In the embodiment illustrated in FIG. 10, control circuits 6 are arranged on rear surface 13 of electronic board 1 and are encapsulated in resin layer 3.

Figure 11:
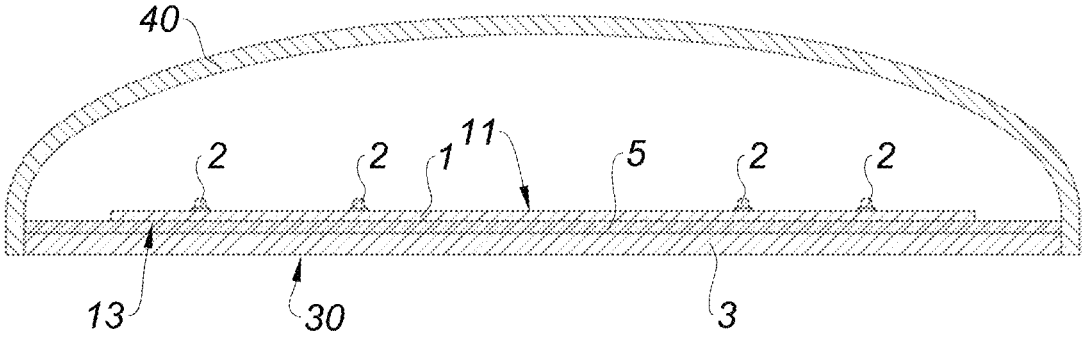
FIG. 11 is a cross-section view of a seventh device according to the invention.

In the embodiment illustrated in FIG. 11, the seventh device differs from the embodiments illustrated in FIGS. 9 and 10 in that the heat transfer means comprise a heat exchanger 5 interposed between electronic board 1 and resin layer 3. Heat exchanger 5 is a metal plate extending all over rear surface 13 of electronic board 1 in direct contact. Resin layer 3 is arranged to cover the metal plate.

Figure 12:
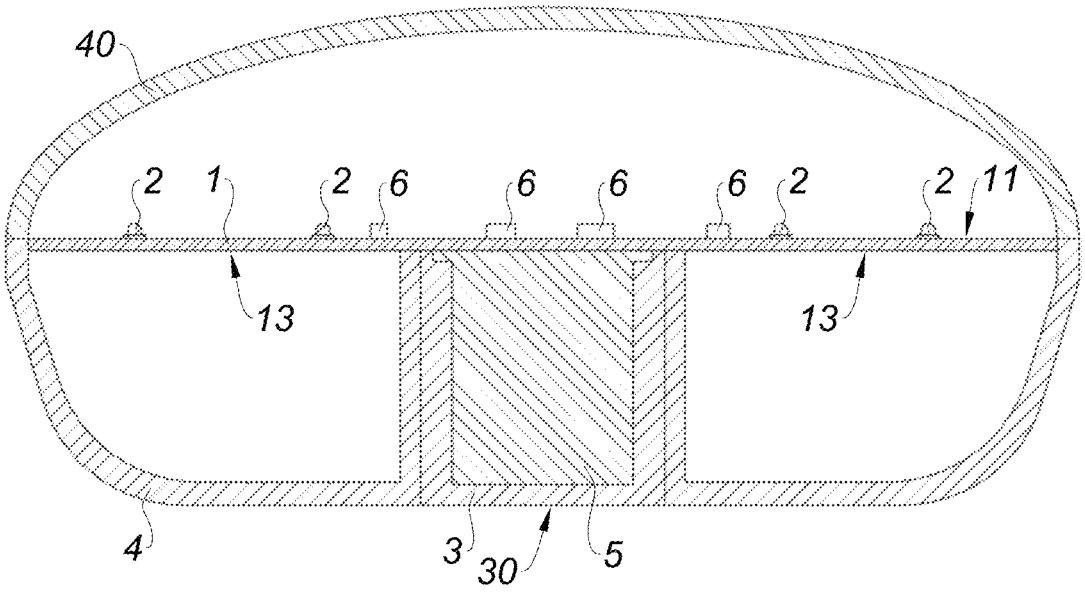
FIG. 12 is a cross-section view of an eighth device according to the invention.

In the embodiment illustrated in FIG. 12, the eighth device differs from the first device in that protective cover 4 comprises a lens 40 which may be made of glass or of a plastic material transparent or translucent in the visible range. Lens 40 is arranged opposite light-emitting means 2. Electronic board 1 comprises a surface, called rear surface 13, opposite to front surface 11. Electronic board 1 comprises circuits 6 for controlling light-emitting means 2. Control circuits 6 are arranged on front surface 11 of electronic board 1. Protective cover 4 comprises portions occupying peripheral areas of rear surface 13 of electronic board 1. Control circuits 6 may also be arranged on said peripheral areas of rear surface 13 of electronic board 1. The heat transfer means comprise a heat exchanger 5, of metal plate type, extending over a central portion of rear surface 13 of electronic board 1. Resin layer 3 is arranged to cover the metal plate. Resin layer 3 is shaped to interpose between the metal plate and said portions of protective cover 4 to ensure the sealing of protective cover 4 with heat exchange surface 30 of resin layer 3. Heat exchange surface 30 is flush with said portions of protective cover 4.

Figure 13:
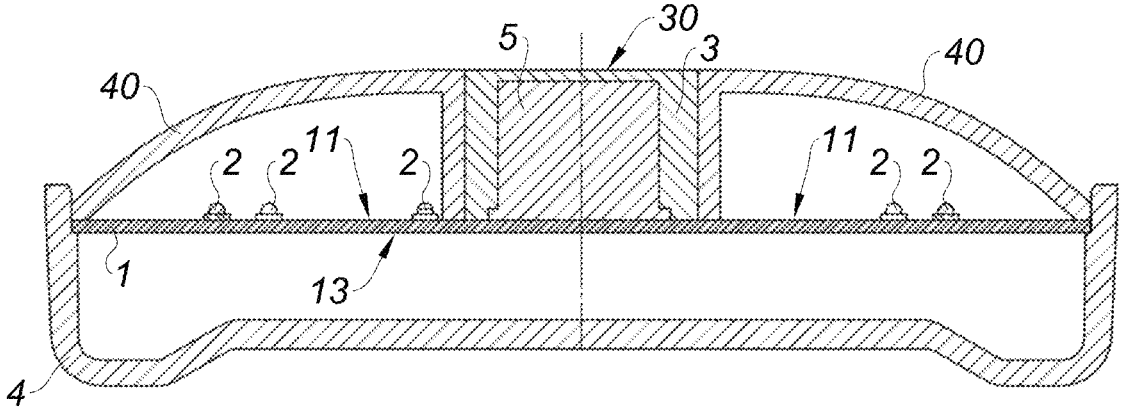
FIG. 13 is a cross-section view of a ninth device according to the invention.

In the embodiment illustrated in FIG. 13, the ninth device differs from the first device in that protective cover 4 comprises lenses 40 which may be made of glass or of a plastic material transparent or translucent in the visible range. Lenses 40 are arranged opposite light-emitting means 2. Lenses 40 of protective cover 4 occupy a peripheral area of front surface 11 of electronic board 1. The heat transfer means comprise a heat exchanger 5, of metal plate type, extending on a central portion of front surface 11 of electronic board 1. Resin layer 3 is arranged to cover the metal plate. Resin layer 3 is shaped to interpose between the metal plate and said lenses 40 of protective cover 4 to ensure the sealing of protective cover 4 with heat exchange surface 30 of resin layer 3. Heat exchange surface 30 is flush with said lenses 40 of protective cover 4.

Figure 14:
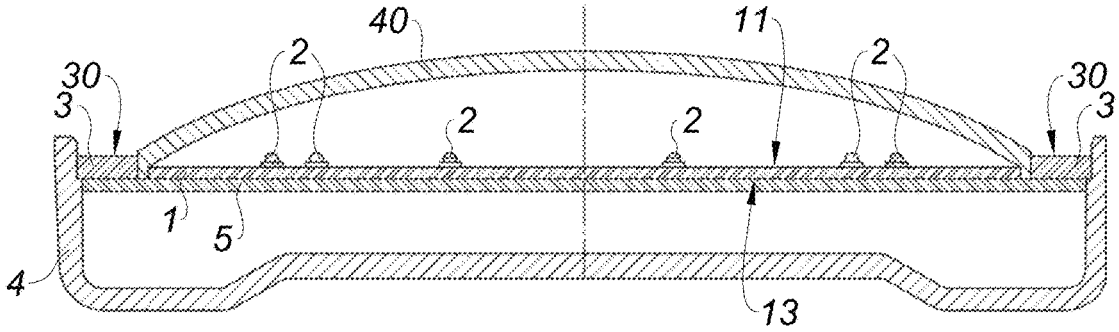
FIG. 14 is a cross-section view of a tenth device according to the invention.

In the embodiment illustrated in FIG. 14, the tenth device differs from the first device in that protective cover 4 comprises a lens 40 which may be made of glass or of a plastic material transparent or translucent in the visible range. Lens 40 is arranged opposite light-emitting means 2. Lens 40 entirely occupies front surface 11 of electronic board 1. The heat transfer means comprise a heat exchanger 5, of metal plate type, assembled on protective cover 4 to extend all over rear surface 13 of electronic board 1 in direct contact. Resin layer 3 rests on the metal plate. Resin layer 3 is shaped to interpose between lens 40 and protective cover 4 to provide the sealing of protective cover 4 with heat exchange surface 30 of resin layer 3.

Figure 15:
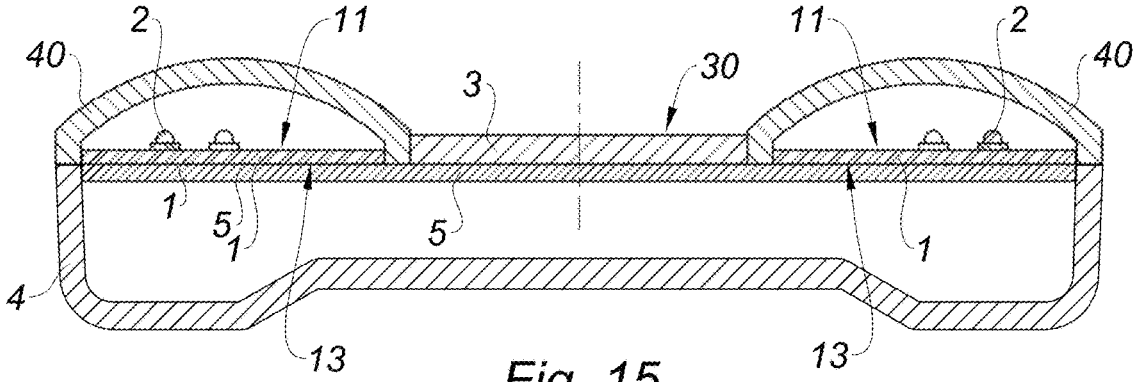
FIG. 15 is a partial cross-section view of an eleventh device according to the invention.

In the embodiment illustrated in FIG. 15, the eleventh device differs from the first device in that protective cover 4 comprises lenses 40 which may be made of glass or of a plastic material transparent or translucent in the visible range. Lenses 40 are arranged opposite light-emitting means 2. The heat transfer means comprise a heat exchanger 5, of metal plate type, assembled on protective cover 4 to extend all over rear surface 13 of electronic board 1 in direct contact. Resin layer 3 rests on the metal plate in its central portion. Resin layer 3 is shaped to interpose between lenses 40 to provide the sealing of protective cover 4 with heat exchange surface 30 of resin layer 3.

Figure 16:
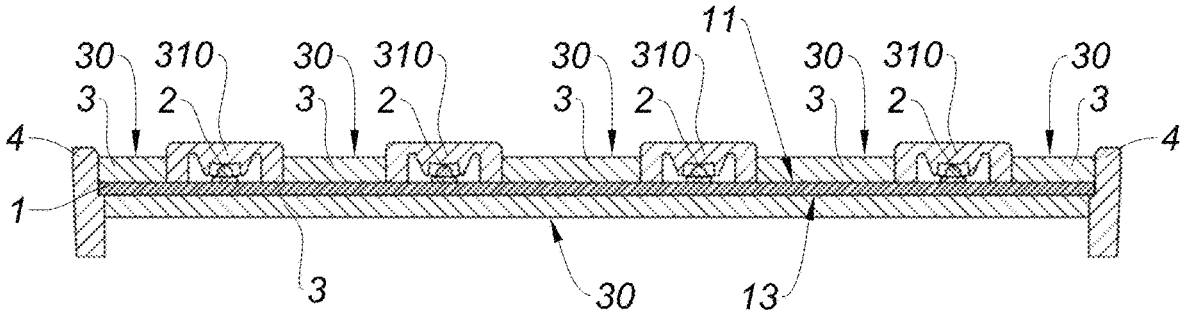
FIG. 16 is a cross-section view of a twelfth device according to the invention.

In the embodiment illustrated in FIG. 16, the twelfth device differs from the first device in that a resin layer 3 extends all over rear surface 13 of electronic board 1 in direct contact.

Figure 17:
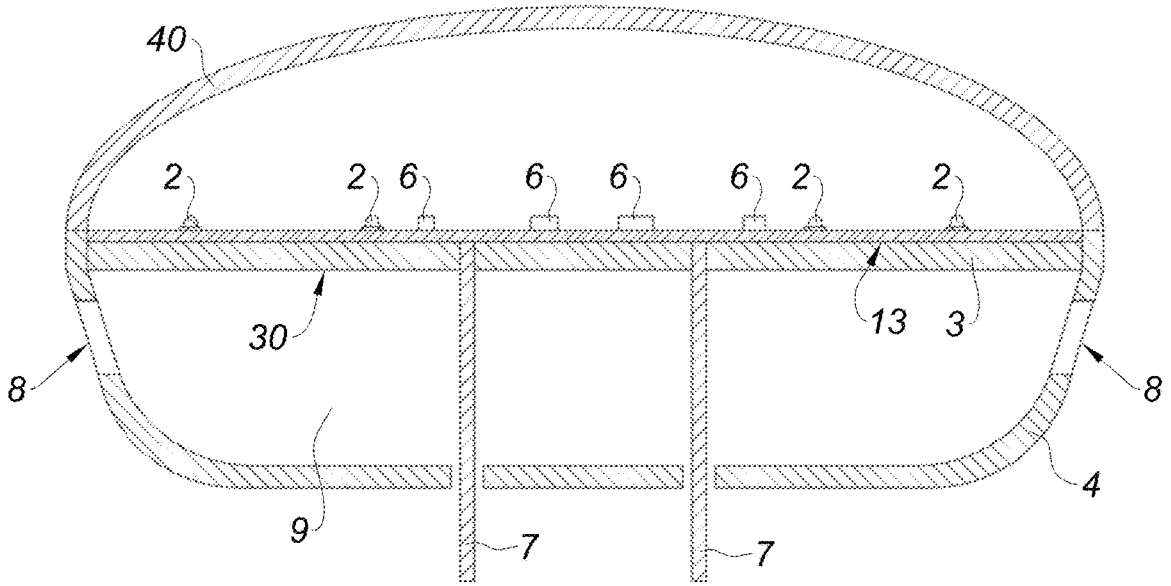
FIG. 17 is a cross-section view of a thirteenth device according to the invention.

In the embodiment illustrated in FIG. 17, the thirteenth device differs from the sixth device illustrated in FIG. 9 in that protective cover 4 comprises a half-shell having lens 40 assembled thereon. The half-shell is arranged opposite resin layer 3. The half-shell is provided with openings 8 capable of allowing the entering of water from the aquatic environment into enclosure 9 defined by the half-shell. Thus, resin layer 3 has a heat exchange surface 30 meant to be in direct contact with the aquatic environment.

Figure 18:
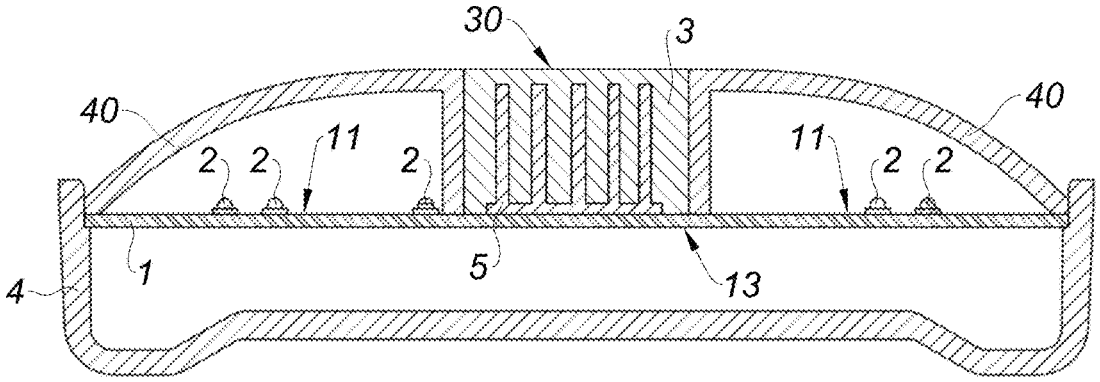
FIG. 18 is a cross-section view of a variation of the ninth device illustrated in FIG. 13.

In the embodiment illustrated in FIG. 18, which is a variation of the ninth device illustrated in FIG. 13, heat exchanger 5 is of U-tube exchanger type.

Figure 19:
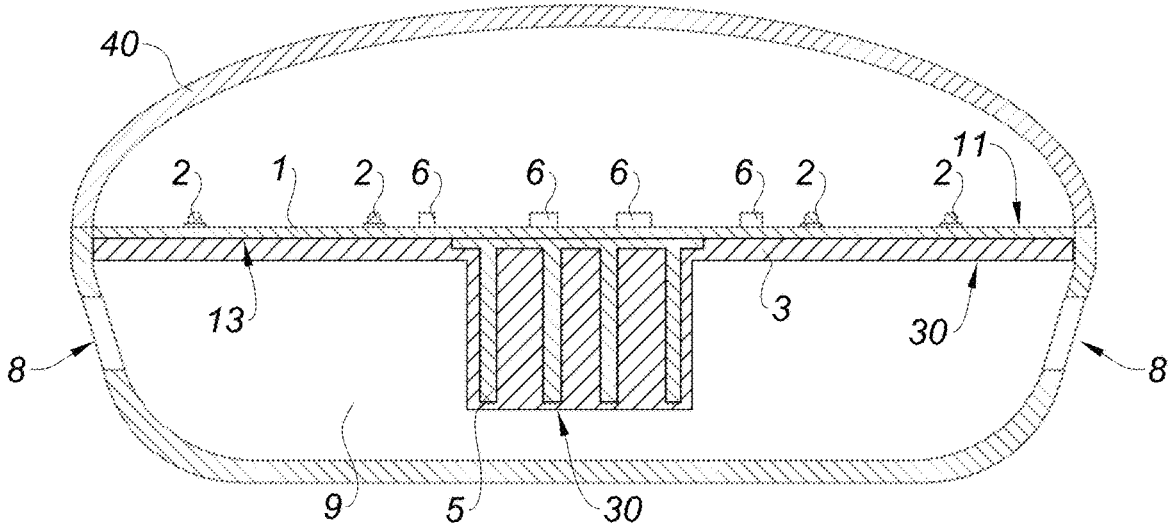
FIG. 19 is a cross-section view of a fourteenth device according to the invention.

In the embodiment illustrated in FIG. 19, the fourteenth device differs from the thirteenth device illustrated in FIG. 17 in that a heat exchanger 5, of U-tube exchanger type, is interposed between a central area of rear surface 13 of electronic board 1 and resin layer 3. According to an alternative embodiment of the fourteenth device (not shown), heat exchanger 5 is a metal plate interposed between rear surface 13 of the electronic board and resin layer 3.

Figure 20:
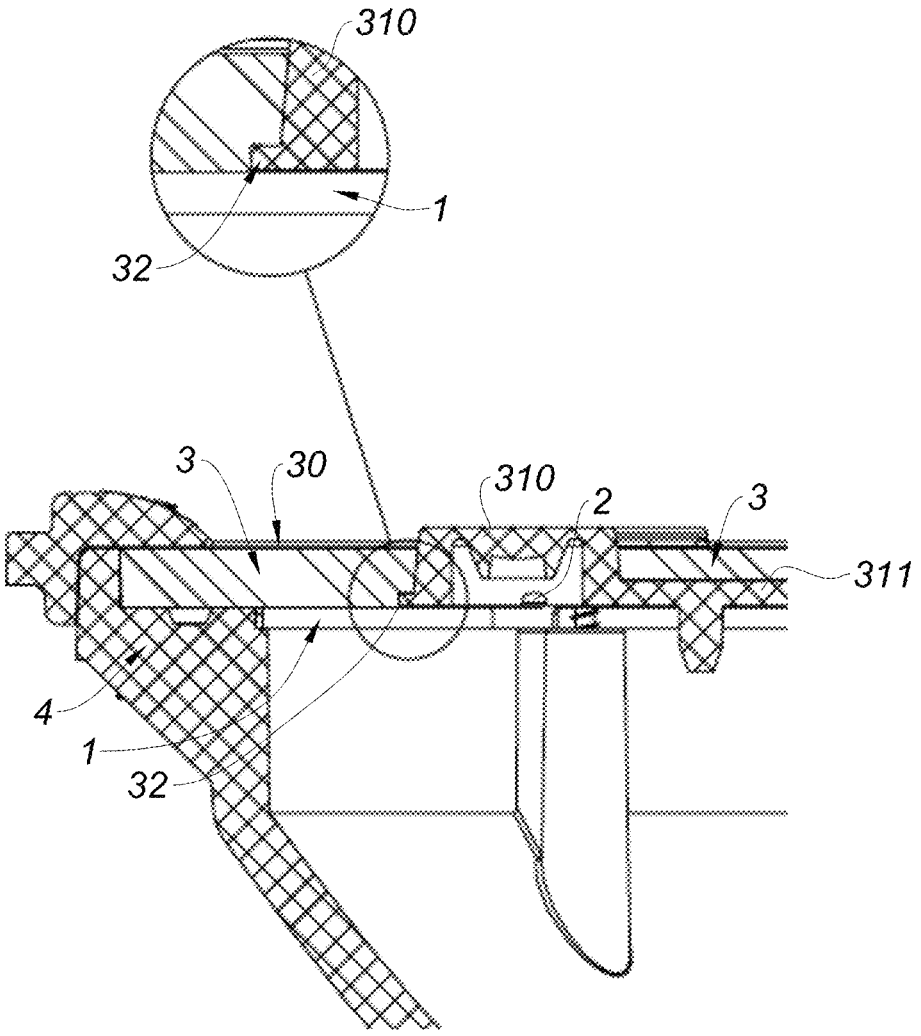
FIG. 20 is a partial cross-section view of a device according to the invention.

In the embodiment illustrated in FIG. 20, the device differs from the first device in that collimators 310 comprise a shoulder 32 extending on front surface 11 of electronic board 1. Resin layer 3 extends on shoulder 32. Shoulder 32 has a substantially L-shaped cross-section.

A method of manufacturing the first device comprises a step of overmolding based on the thermally-conductive resin on the complementary area of front surface 11 of electronic board 1. Collimators 310 may comprise means for preventing a translation of the resin along the direction perpendicular to said front surface 11 in case of an overmolding above collimators 310. It may be advantageous to form a resin thickness smaller than the height of collimators 310.

The invention claimed is:

1. An underwater lighting device, including:

an electronic board comprising a surface, called front surface;

at least one light emitter assembled on the front surface of the electronic board;

a protective cover configured to protect the electronic board and the at least one light emitter;

at least one thermally-conductive resin layer configured to transfer the heat generated by the at least one light emitter to the aquatic environment, the at least one thermally-conductive resin layer having a heat exchange surface configured to be in direct contact with the aquatic environment, the at least one thermally-conductive resin layer being configured with respect to the electronic board so as to transfer the heat generated by the at least one light emitter to the heat exchange surface, the at least one thermally-conductive resin layer being configured relatively to the protective cover to ensure the sealing of the protective cover with the heat exchange surface;

the protective cover comprising at least one lens arranged opposite the at least one light emitter and occupying a peripheral area of the front surface of the electronic board;

the device further comprising a heat exchanger assembled on the protective cover;

the heat exchanger extending all over a rear surface of the electronic board in direct contact; and the at least one thermally-conductive resin layer being resting on the heat exchanger.

2. The device according to claim 1, wherein the heat exchanger is selected from the group comprising a metal plate and a U-tube exchanger.

3. The device according to claim 1, wherein the at least one thermally-conductive resin layer comprises a metal filler.

4. The device according to claim 1, wherein the at least one thermally-conductive resin layer and the electronic board have expansion coefficients to avoid the tearing of the at least one light emitter.

5. The device according to claim 1, wherein the at least one thermally-conductive resin layer is formed from a cast resin selected from the group comprising polyepoxides, polyurethanes, polyesters, polysiloxanes, acrylics, and methyl methacrylates.

* * * * *